United States Patent [19]

Hiramitsu et al.

[11] Patent Number: 5,074,922

[45] Date of Patent: Dec. 24, 1991

[54] METHOD OF PRODUCING BERYLLIUM COPPER ALLOY MEMBER

[75] Inventors: Hiroyuki Hiramitsu; Tomoyuki Maebashi; Takaharu Iwadachi, all of Handa, Japan

[73] Assignee: NGK Insulators, Ltd., Japan

[21] Appl. No.: 594,005

[22] Filed: Oct. 9, 1990

[30] Foreign Application Priority Data

Oct. 27, 1989 [JP] Japan ..... 1-281098

[51] Int. Cl.[5] ..... C21D 8/06

[52] U.S. Cl. ..... 148/11.5 C; 148/2

[58] Field of Search ..... 148/2, 11.5 C, 12.7 C

[56] References Cited

U.S. PATENT DOCUMENTS 4,179,314 12/1979 Wikle ..... 148/12.7 C 4,394,185 7/1983 McClelland et al. ..... 148/11.5 C 4,425,168 1/1984 Goldstein et al. ..... 148/2

*Primary Examiner*—R. Dean

*Assistant Examiner*—George Wyszomierski

*Attorney, Agent, or Firm*—Parkhurst, Wendel & Rossi

[57] ABSTRACT

A beryllium copper alloy member is provided having both a high electrical conductivity of not less than 70% IACS and a high strength of not less than 70 kgf/mm$^2$ by an extensively simplified production method which widely decreases the production cost of the alloy member. The method includes, shaping a cast ingot alloy consisting in weight basis of 0.15–0.6% of Be, 0.6–3.0% of Ni, and the test of Cu and unavoidable impurities to a desired shape by working it to destroy the cast organization structure of the alloy, heat annealing the shaped alloy at a condition of 400°-650° C.×1-100 hrs, and cold working the heat annealed alloy to a final shape by a working rate of at least 80%.

9 Claims, 2 Drawing Sheets

METHOD OF PRODUCING BERYLLIUM COPPER ALLOY MEMBER

BACKGROUND OF THE INVENTION

1. Field of the Invention

The present invention relates to a method of producing beryllium copper alloy members, such as, electrode members, lead frame members, and the like members which are required to have high electrical conductivity and high strength.

2. Related Art Statement

Heretofore, in order to produce beryllium copper alloy members of this type having high electrical conductivity and high strength, a production method has been used wherein a cold worked alloy is stabilized and then cold worked, or a production method wherein the solubilized alloy is cold worked and then further age-hardened. Such prior methods perform complicated process steps of heat annealing, cold working, solubilizing, cold working, and age-hardening, so that it is different to maintain the production cost of the alloy at a low level.

As to the characteristic properties of the alloys, a prior representative 42 alloy has a strength of 70 kgf/mm$^2$ and an electrical conductivity of 5% IACS, and another prior representative CCZ (Cr-Cu-Zr series) alloy has a strength of 50 kgf/mm$^2$ and an electrical conductivity of 80% IACS. Therefore, a beryllium copper alloy member having an electrical conductivity of not less than 70% IACS, while simultaneously having a strength of not less than 70 kgf/mm$^2$, has been eagerly desired.

SUMMARY OF THE INVENTION

An object of the present invention is to obviate the problems of the prior methods.

Another object of the present invention is to provide a method of producing beryllium copper alloy members having an electrical conductivity of not less than 70% IACS and a strength of not less than 70 kgf/mm$^2$ which has such simplified process steps that the production cost of the alloy members can be decreased substantially.

In the first aspect of the present invention, the present invention is a method of producing beryllium copper alloy member, wherein a cast ingot of a beryllium copper alloy consisting in weight basis of 0.15–0.6% of Be, 0.6–3.0% of Ni, and the rest of Cu and unavoidable impurities is shaped to a desired form by working it to destroy the cast organization structure thereof, the shaped alloy is heat annealed at a condition of 400°–650° C.×1–100 hr, and the heat annealed alloy is further processed to a final shape by a cold working of a working rate of not less than 80%.

In the second aspect of the present invention, the Ni component of 0.6–3.0 wt % in the first aspect of the present invention is replaced by Co component of 0.6–5.0 wt %. Hereinafter, amounts expressed by % are weight basis, unless otherwise specified.

In the third aspect of the present invention, the Ni component of 0.6–3.0% in the first aspect is replaced by 0.6–5.0% of Ni+Co (wherein Ni≦3.0%).

In this way, the present invention has remarkable features that the heretofore effected solubilizing treatment step and age-hardening treatment step are dispensed with, and that the heat annealing temperature is widely decreased from the conventional temperature of at least 800° C. to a temperature of 400°–650° C.

In the present invention, the heat annealing is effected in a hyper age-hardening region of a relatively low temperature so as to precipitate intermetallic compounds, such as nickel berylite (Ni-Be), etc., and the purity of the remaining organization structure of the beryllium copper alloy is improved so as to increase the electrical conductivity of the alloy up to at least 70% IACS. In addition thereto, a cold working is effected at a working rate of at least 80% to obtain a beryllium copper alloy member of a strength of at least 70 kgf/mm$^2$.

In the first aspect of the present invention, a beryllium copper alloy of a composition consisting of 0.15–0.6% of Be, 0.6–3.0% of Ni, and the rest of Cu, is used. If Be is less than 0.15% or Ni is less than 0.6%, a sufficient amount of nickel berylite is not precipitated, so that the purposed strength of the alloy member can not be obtained. While, if Be exceeds 0.6% or Ni exceeds 3.0%, the purposed electrical conductivity of the alloy member can not be obtained.

In the second aspect of the present invention, a beryllium copper alloy of a composition consisting of 0.15–0.6% of Be, 0.6–5.0% of Co, and the rest of Cu, is used. In this case, too, if the amount of Co is below the above range, the amount of precipitation of the intermetallic compounds becomes insufficient, so that the strength of the alloy member is decreased, and if the amount of Co is excessively large, the electrical conductivity of the alloy member is decreased.

In the third aspect of the present invention, a beryllium copper alloy of a composition consisting of 0.15–0.6% of Be, 0.6–5.0% of Ni+Co, and the rest of Cu, is used. In this case, too, if the amount of Ni+Co is insufficient, the strength of the alloy member is decreased, and if the amount of Ni+Co is excessively large, the electrical conductivity of the alloy member is decreased, similarly as in the other aspects of the present invention.

In the first through the third aspects of the present invention, a heat annealing condition of 400°–650° C.×1–100 hr is used. If the heat annealing temperature is less than 400° C., a sufficient amount of the intermetallic compounds is not precipitated, while, if the temperature exceeds 650° C., once precipitated intermetallic compounds are again solubilized into the organization structure of the alloy, so that in either case the purposed high electrical conductivity of the alloy member can not be obtained. The heat annealing time is varied naturally depending on the heat annealing temperature. However, if the heat annealing time is less than 1 hr, an insufficient amount of the intermetallic compounds is precipitated, even when the heat annealing is effected at 650° C., so that the purposed strength and electrical conductivity can not be obtained. While, if the heat annealing time exceeds 100 hrs, both the strength and the electrical conductivity of the alloy member are decreased, even when the heat annealing is effected at 400° C., and the production cost of the alloy member is increased, so that the purposed merit in the production of the alloy member can not be obtained.

In the present invention, a cold working of a working rate of at least 80% is effected, because if the working rate expressed by an equation of (size after working-original size)×100/original size is less than 80%, the purposed strength of the alloy member can not be obtained.

BRIEF DESCRIPTION OF THE DRAWINGS

For a better understanding of the present invention, reference is made to the accompanying drawings, in which.

DESCRIPTION OF THE PREFERRED EMBODIMENTS

Figure 1:
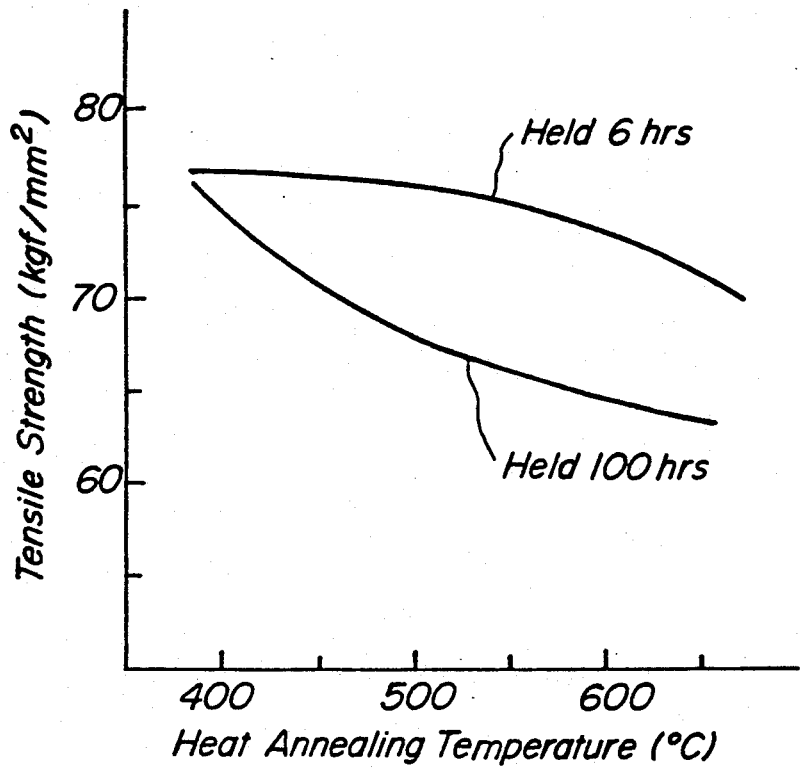
FIG. 1 is a characteristic graph of a beryllium copper alloy member consisting essentially of 0.28 wt % of Be, 1.23 wt % of Ni, and the remainder of Cu and unavoidable impurities, showing a relation between the heat annealing temperature and the tensile strength of the alloy member when maintained at a heat annealing time of 6 or 100 hrs.

Cast ingots of Be-Ni series alloys having the compositions as shown in Table 1, Be-Co series alloys having the compositions as shown in Table 2, and Be-Ni-Co series alloys having the compositions as shown in Table 3, are casted and worked to form plates of a thickness of 2.5 t. The plates are heat annealed at 350°–650° C. for 0.5–100 hrs, and then cold worked at working rates of 75% and 85% to obtain plates of a thickness of 0.37 t and 0.625 t, respectively. The plates are tested on tensile strength and electrical conductivity. The results are shown in Tables 1–3.

TABLE 1

Be—Ni Series Alloys

| No. | Be wt % | Ni wt % | Heat Annealing Temperature °C. | Heat Annealing time hrs | Working rate % | Tensile Strength kgf/mm² | IACS % |
|---|---|---|---|---|---|---|---|
| 1 | 0.12 | 0.61 | 500 | 12 | 85 | 63.2 | 72.1 |
| 2 | 0.16 | 0.20 | 500 | 12 | 85 | 62.8 | 83.0 |
| 3 | 0.16 | 1.52 | 400 | 100 | 85 | 70.1 | 75.4 |
| 4 | 0.16 | 1.52 | 500 | 12 | 85 | 70.2 | 74.8 |
| 5 | 0.16 | 1.52 | 500 | 100 | 85 | 70.1 | 75.2 |
| 6 | 0.16 | 3.21 | 500 | 12 | 85 | 72.1 | 67.1 |
| 7 | 0.28 | 0.42 | 500 | 12 | 85 | 64.5 | 74.2 |
| 8 | 0.28 | 0.61 | 500 | 12 | 85 | 72.4 | 73.0 |
| 9 | 0.28 | 0.61 | 500 | 12 | 75 | 69.1 | 74.3 |
| 10 | 0.28 | 1.92 | 400 | 100 | 85 | 75.4 | 74.8 |
| 11 | 0.28 | 1.92 | 400 | 100 | 75 | 69.2 | 75.2 |
| 12 | 0.28 | 1.92 | 500 | 12 | 85 | 76.5 | 78.2 |
| 13 | 0.28 | 1.92 | 500 | 12 | 75 | 69.1 | 80.5 |
| 14 | 0.28 | 1.92 | 600 | 12 | 85 | 74.8 | 75.2 |
| 15 | 0.28 | 1.92 | 600 | 0.5 | 85 | 68.4 | 67.4 |
| 16 | 0.28 | 1.92 | 600 | 1.5 | 85 | 72.4 | 73.1 |
| 17 | 0.28 | 1.92 | 650 | 1.5 | 85 | 64.2 | 74.5 |
| 18 | 0.28 | 1.92 | 350 | 100 | 85 | 79.9 | 60.8 |
| 19 | 0.28 | 2.95 | 400 | 100 | 85 | 78.8 | 70.9 |
| 20 | 0.28 | 2.95 | 500 | 12 | 85 | 72.8 | 71.5 |
| 21 | 0.28 | 2.95 | 500 | 12 | 75 | 68.9 | 72.3 |
| 22 | 0.28 | 2.95 | 600 | 1.5 | 85 | 70.2 | 73.8 |
| 23 | 0.28 | 3.52 | 500 | 12 | 85 | 74.2 | 68.3 |
| 24 | 0.37 | 0.65 | 500 | 12 | 85 | 70.0 | 70.8 |
| 25 | 0.37 | 1.52 | 500 | 12 | 85 | 70.9 | 71.5 |
| 26 | 0.37 | 2.98 | 400 | 100 | 85 | 74.8 | 74.2 |
| 27 | 0.37 | 2.98 | 500 | 12 | 85 | 75.1 | 75.2 |
| 28 | 0.37 | 2.98 | 500 | 12 | 75 | 69.4 | 75.8 |
| 29 | 0.37 | 2.98 | 600 | 1.5 | 85 | 73.2 | 75.1 |
| 30 | 0.37 | 2.98 | 650 | 1.5 | 85 | 66.7 | 76.8 |
| 31 | 0.37 | 2.98 | 350 | 100 | 85 | 77.8 | 67.8 |
| 32 | 0.37 | 3.61 | 500 | 12 | 85 | 67.8 | 64.2 |
| 33 | 0.58 | 1.51 | 500 | 12 | 85 | 71.2 | 71.4 |
| 34 | 0.58 | 2.52 | 500 | 12 | 85 | 73.4 | 74.2 |
| 35 | 0.58 | 2.52 | 500 | 12 | 75 | 69.5 | 75.2 |
| 36 | 0.58 | 3.52 | 500 | 12 | 85 | 66.7 | 65.1 |
| 37 | 0.67 | 2.32 | 500 | 12 | 85 | 64.5 | 63.2 |

TABLE 2

Be—Co Series Alloys

| No. | Be wt % | Ni wt % | Heat Annealing Temperature °C. | Heat Annealing time hrs | Working rate % | Tensile Strength kgf/mm² | IACS % |
|---|---|---|---|---|---|---|---|
| 1 | 0.11 | 0.51 | 500 | 12 | 85 | 67.5 | 68.2 |
| 2 | 0.17 | 0.32 | 500 | 12 | 85 | 68.3 | 69.9 |
| 3 | 0.17 | 1.60 | 400 | 100 | 85 | 72.8 | 71.9 |
| 4 | 0.17 | 1.60 | 500 | 12 | 85 | 73.2 | 72.1 |
| 5 | 0.17 | 1.60 | 500 | 100 | 85 | 72.1 | 73.2 |
| 6 | 0.17 | 3.21 | 500 | 12 | 85 | 74.3 | 73.8 |
| 7 | 0.31 | 0.41 | 500 | 12 | 85 | 68.4 | 74.1 |
| 8 | 0.31 | 0.62 | 500 | 12 | 85 | 72.1 | 73.8 |
| 9 | 0.31 | 0.62 | 500 | 12 | 75 | 69.4 | 74.4 |

TABLE 2-continued

| Be—Co Series Alloys | | | | | | | |
|---|---|---|---|---|---|---|---|
| No. | Be wt % | Ni wt % | Heat Annealing Temperature °C. | Heat Annealing time hrs | Working rate % | Tensile Strength kgf/mm² | IACS % |
| 10 | 0.31 | 2.32 | 400 | 100 | 85 | 71.9 | 73.9 |
| 11 | 0.31 | 2.32 | 400 | 100 | 75 | 69.1 | 74.6 |
| 12 | 0.31 | 2.32 | 500 | 12 | 85 | 74.8 | 75.9 |
| 13 | 0.31 | 2.32 | 500 | 12 | 75 | 69.8 | 78.1 |
| 14 | 0.31 | 2.32 | 600 | 12 | 85 | 73.1 | 75.2 |
| 15 | 0.31 | 2.32 | 600 | 0.5 | 85 | 68.2 | 67.1 |
| 16 | 0.31 | 2.32 | 600 | 1.5 | 85 | 72.1 | 72.2 |
| 17 | 0.31 | 2.32 | 650 | 1.5 | 85 | 65.4 | 70.2 |
| 18 | 0.31 | 2.32 | 350 | 100 | 85 | 75.4 | 66.2 |
| 19 | 0.31 | 4.65 | 400 | 100 | 85 | 70.5 | 71.1 |
| 20 | 0.31 | 4.95 | 500 | 12 | 85 | 71.2 | 70.9 |
| 21 | 0.31 | 4.95 | 500 | 12 | 75 | 69.1 | 72.1 |
| 22 | 0.31 | 4.95 | 600 | 1.5 | 85 | 70.1 | 70.5 |
| 23 | 0.31 | 5.45 | 500 | 12 | 85 | 68.5 | 62.2 |
| 24 | 0.42 | 0.63 | 500 | 12 | 85 | 74.4 | 73.8 |
| 25 | 0.42 | 1.86 | 350 | 100 | 85 | 75.2 | 65.8 |
| 26 | 0.42 | 1.86 | 400 | 100 | 85 | 74.5 | 72.9 |
| 27 | 0.42 | 1.86 | 500 | 12 | 85 | 74.6 | 73.2 |
| 28 | 0.42 | 1.86 | 500 | 12 | 75 | 69.1 | 74.5 |
| 29 | 0.42 | 1.86 | 600 | 1.5 | 85 | 72.1 | 71.8 |
| 30 | 0.42 | 1.86 | 650 | 1.5 | 85 | 68.1 | 70.2 |
| 31 | 0.42 | 3.21 | 500 | 12 | 85 | 76.6 | 75.8 |
| 32 | 0.42 | 4.95 | 500 | 12 | 85 | 75.8 | 73.2 |
| 33 | 0.59 | 5.14 | 500 | 12 | 85 | 68.8 | 67.8 |
| 34 | 0.59 | 1.50 | 500 | 12 | 85 | 70.2 | 74.8 |
| 35 | 0.59 | 2.89 | 500 | 12 | 75 | 71.5 | 73.6 |
| 36 | 0.59 | 3.92 | 500 | 12 | 85 | 71.8 | 72.2 |
| 37 | 0.59 | 3.92 | 500 | 12 | 75 | 69.1 | 72.8 |
| 38 | 0.59 | 4.98 | 500 | 12 | 85 | 72.4 | 71.4 |
| 39 | 0.59 | 5.41 | 500 | 12 | 85 | 71.6 | 68.4 |
| 40 | 0.67 | 2.49 | 500 | 12 | 85 | 74.2 | 64.8 |
| 41 | 0.67 | 2.49 | 500 | 12 | 75 | 71.1 | 67.2 |

TABLE 3

| Be—Ni—Co Series Alloys | | | | | | | | |
|---|---|---|---|---|---|---|---|---|
| No. | Be wt % | Ni wt % | Co wt % | Heat Annealing Temperature °C. | Heat Annealing time hrs | Working rate % | Tensile Strength kgf/mm² | IACS % |
| 1 | 0.32 | 0.51 | 1.12 | 500 | 12 | 85 | 74.3 | 76.2 |
| 2 | 0.32 | 0.71 | 2.23 | 500 | 12 | 85 | 75.8 | 74.2 |
| 3 | 0.32 | 0.71 | 2.23 | 400 | 12 | 75 | 69.4 | 75.8 |
| 4 | 0.32 | 1.21 | 3.21 | 500 | 12 | 85 | 72.8 | 72.2 |
| 5 | 0.42 | 0.68 | 1.22 | 500 | 12 | 85 | 73.8 | 73.7 |
| 6 | 0.42 | 0.77 | 2.41 | 500 | 12 | 85 | 72.4 | 72.1 |
| 7 | 0.42 | 1.28 | 3.18 | 500 | 12 | 85 | 70.2 | 71.2 |
| 8 | 0.32 | 0.28 | 0.28 | 500 | 12 | 85 | 62.4 | 67.2 |
| 9 | 0.32 | 1.23 | 4.83 | 500 | 12 | 85 | 69.2 | 63.4 |

Figure 2:
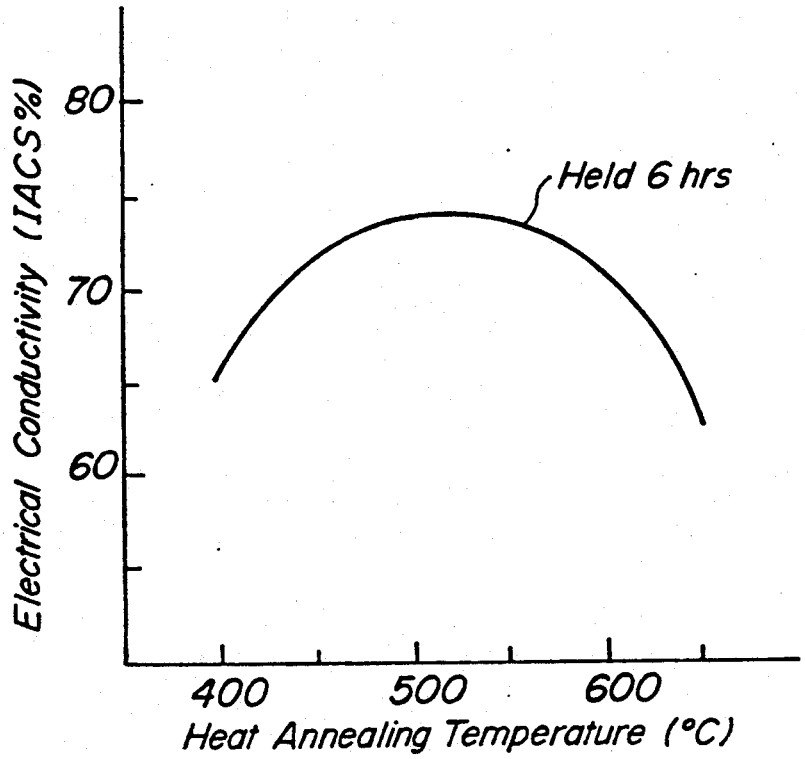
FIG. 2 is a characteristic graph of the same alloy, showing a relation between the heat annealing temperature and the electrical conductivity of the alloy member when maintained at a heat annealing time of 6 hrs.
Figure 3:
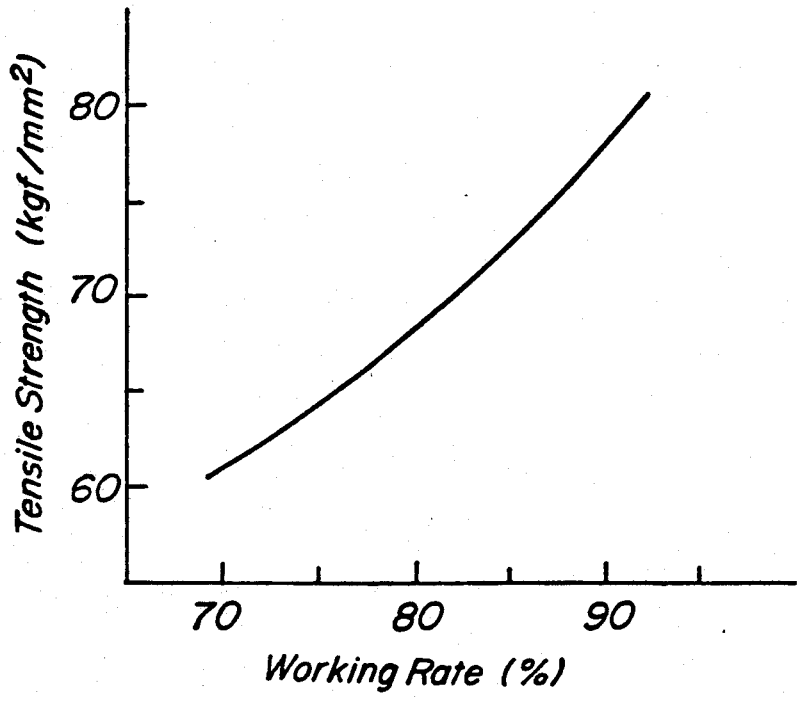
FIG. 3 is a characteristic graph of the same alloy, showing a relation between the working rate percentage and the tensile strength of the alloy member.

A beryllium copper alloy of a composition consisting of 0.28% of Be, 1.23% of Ni, and the rest of Cu are tested on a relation between the heat annealing temperature and the heat annealing time the result of which is as shown in FIG. 1, a relation between the heat annealing temperature, the heat annealing time and the electrical conductivity the result of which is as shown in FIG. 2, and a relation between the working rate and the tensile strength the result of which is as shown in FIG. 3.

The beryllium copper alloy members produced by the method of the present invention are suited well to electrode members, parts of cooling devices, lead frame members, and the like.

As apparent from the foregoing explanations, the present invention achieves the strength of at least 70 kgf/mm² and the electrical conductivity of at least 70% IACS simultaneously which heretofore was impossible, and affords extensive decrease of the production cost without necessitating heretofore required solubilizing treatment and age-hardening treatment. Therefore, the present invention obviates the prior problems and drawbacks, and contributes to a great extent to the development of the industry.

Although the present invention has been described with reference to specific examples and numerical values, it should be understood that the present invention is not restricted to such examples and numerical values, and numerous changes and modifications are possible without departing from the broad spirit and the aspect of the present invention as defined in the appended claims.

What is claimed is:

1. A method of producing a beryllium copper alloy member, consisting essentially of the steps of shaping a cast ingot alloy consisting in weight basis of 0.15–0.6% of Be, 0.6–3.0% of Ni, and the rest of Cu and unavoidable impurities to a desired shape by working it to destroy the cast organization structure of the alloy, heat annealing the shaped alloy at a condition of 400°–650°

C.×1-100 hrs, and cold working the heat annealed alloy to a final shape by a working rate of at least 80%.

2. The method of claim 1, wherein said beryllium copper alloy member has a tensile strength of at least 60 kgf/mm$^2$ and an electrical conductivity of at least 60% IACS.

3. The method of claim 1, wherein said beryllium copper alloy member has a tensile strength of at least 70 kgf/mm$^2$ and an electrical conductivity of at least 70% IACS.

4. A method of producing a beryllium copper alloy member, consisting essentially of the steps of shaping a cast ingot alloy consisting in weight basis of 0.15-0.6% of Be, 0.6-5.0% of Co, and the rest of Cu and unavoidable impurities to a desired shape by working it to destroy the cast organization structure of the alloy, heat annealing the shaped alloy at a condition of 400°-650° C.×1-100 hrs, and cold working the heat annealed alloy to a final shape by a working rate of at least 80%.

5. The method of claim 4, wherein said beryllium copper alloy member has a tensile strength of at least 60 kgf/mm$^2$ and an electrical conductivity of at least 60% IACS.

6. The method of claim 4, wherein said beryllium copper alloy member has a tensile strength of at least 70 kgf/mm$^2$ and an electrical conductivity of at least 70% IACS.

7. A method of producing a beryllium copper alloy member, consisting essentially of the steps of shaping a cast ingot alloy consisting in weight basis of 0.15-0.6% of Be, 0.6-5.0% of Ni+Co, wherein Ni≦3.0%, and the rest of Cu and unavoidable impurities to a desired shape by working it to destroy the cast organization structure of the alloy, heat annealing the shaped alloy at a condition of 400°-650° C.X1-100 hrs, and cold working the heat annealed alloy to a final shape by a working rate of at least 80%.

8. The method of claim 7, wherein said beryllium copper alloy member has a tensile strength of at least 60 kgf/mm$^2$ and an electrical conductivity of at least 60% IACS.

9. The method of claim 7, wherein said beryllium copper alloy member has a tensile strength of at least 70 kgf/mm$^2$ and an electrical conductivity of at least 70% IACS.

* * * * *